US005494788A

United States Patent [19]

Chang et al.

[11] Patent Number: 5,494,788

[45] Date of Patent: Feb. 27, 1996

[54] CHEMICAL AND SPECTRAL SENSITIZATION OF HIGH-CHLORIDE TABULAR GRAINS USING HIGH-TEMPERATURE HEAT TREATMENT

[75] Inventors: Yun C. Chang, Rochester; Jerzy A. Budz, Fairport, both of N.Y.

[73] Assignee: Eastman Kodak Company, Rochester, N.Y.

[21] Appl. No.: 315,031

[22] Filed: Sep. 29, 1994

[51] Int. Cl.[6] ..... G03C 1/035; G03C 1/16; G03C 1/34

[52] U.S. Cl. ..... 430/567; 430/570; 430/583; 430/588; 430/599; 430/603; 430/605; 430/614

[58] Field of Search ..... 430/567, 570, 430/583, 588, 599, 603, 605, 614

[56] References Cited

U.S. PATENT DOCUMENTS

| | | | |
|---|---|---|---|
| 4,150,994 | 4/1979 | Matermaghan | 430/567 |
| 4,184,877 | 1/1980 | Maternaghan | 430/567 |
| 4,400,463 | 8/1983 | Maskasky | 430/567 |
| 4,713,323 | 12/1987 | Maskasky | 430/569 |
| 4,783,398 | 11/1988 | Takada et al. | 430/567 |
| 4,801,523 | 1/1989 | Tufano | 430/589 |
| 4,804,621 | 2/1989 | Tufano et al. | 430/567 |
| 4,952,491 | 8/1990 | Nishikawa et al. | 430/567 |
| 4,983,508 | 1/1991 | Ishiguro et al. | 430/567 |
| 5,017,469 | 5/1991 | Mowforth et al. | 430/569 |
| 5,035,992 | 7/1991 | Houle et al. | 430/569 |
| 5,061,615 | 10/1991 | Kase et al. | 430/569 |
| 5,176,991 | 1/1993 | Jones et al. | 430/569 |
| 5,183,732 | 2/1993 | Maskasky | 430/569 |
| 5,217,858 | 6/1993 | Maskasky | 430/567 |
| 5,221,602 | 6/1993 | Maskasky | 430/569 |

FOREIGN PATENT DOCUMENTS

| | | |
|---|---|---|
| 0304908 | 3/1989 | European Pat. Off. . |
| 0430196A1 | 6/1991 | European Pat. Off. . |
| 0532801A1 | 3/1993 | European Pat. Off. . |
| 3116133 | 5/1991 | Japan . |

OTHER PUBLICATIONS

Abstract of JP 3–288143.

Abstract of JP 5–134340.

Research Disclosure 308119, Section IIIA, Dec. 1989.

*Primary Examiner*—Janet C. Baxter

*Attorney, Agent, or Firm*—Paul A. Leipold

[57] ABSTRACT

The invention relates to a method of sensitizing (111) high chloride tabular grains having {111} major faces comprising providing the high chloride tabular grains, and sensitizing using temperatures greater than 70° C.

12 Claims, No Drawings

CHEMICAL AND SPECTRAL SENSITIZATION OF HIGH-CHLORIDE TABULAR GRAINS USING HIGH-TEMPERATURE HEAT TREATMENT

FIELD OF THE INVENTION

The invention relates to the preparation of silver halide particles for photographic use.

BACKGROUND OF THE INVENTION

Radiation sensitive silver halide emulsions containing one or a combination of chloride, bromide and iodide ions have been long recognized to be useful in photography. Each halide ion selection is known to impart particular photographic advantages. By a wide margin the most commonly employed photographic emulsions are silver bromide and silver bromoiodide emulsions. Although known and used for many years for selected photographic applications, the more rapid developability and the ecological advantages of high chloride emulsions have provided an impetus for employing these emulsions over a broader range of photographic applications.

During the 1980's a marked advance took place in silver halide photography based on the discovery that a wide range of photographic advantages, such as improved speed-granularity relationships, increased covering power both on an absolute basis and as a function of binder hardening, more rapid developability, increased thermal stability, increased separation of native and spectral sensitization imparted imaging speeds, and improved image sharpness in both mono- and multi-emulsion layer formats, can be realized by increasing the proportions of selected tabular grain populations in photographic emulsions.

In almost every instance tabular grain emulsions have been formed by introducing two or more parallel twin planes into octahedral grains during their preparation. Regular octahedral grains are bounded by {111} crystal faces. The predominant feature of tabular grains formed by twinning are opposed parallel {111} major crystal faces. The major crystal faces have a threefold symmetry, typically appearing triangular or hexagonal.

The formation of tabular grain emulsions containing parallel twin planes is most easily accomplished in the preparation of silver bromide emulsions. The art has developed the capability of including photographically useful levels of iodide. The inclusion of high levels of chloride as opposed to bromide, alone or in combination with iodide, has been difficult. Silver chloride differs from silver bromide in exhibiting a much stronger propensity toward the formation of grains with faces lying in {100} crystallographic planes. To produce successfully a high chloride tabular grain emulsion by twinning, conditions must be found that favor both the formation of twin planes and {111} crystal faces. Further, after the emulsions has been formed, tabular grain morphological stabilization is required to avoid reversion of the grains to their favored more stable form exhibiting {100} crystal faces. When high chloride tabular grains having {111} major faces undergo morphological reversion to forms presenting {100} grain faces the tabular character of the grains is either significantly degraded or entirely destroyed and this results in the loss of the photographic advantages known to be provided by tabular grains.

Maskasky U.S. Pat. No. 4,400,463 was the first to prepare in the presence of an adsorbed grain growth modifier a high chloride emulsion containing tabular grains with parallel twin planes and {111} major crystal faces. The strategy was to use a particularly selected synthetic polymeric peptizer in combination with an adsorbed aminoazaindene, preferably adenine, acting as a grain growth modifier.

Maskasky U.S. Pat. No. 4,713,323 significantly advanced the state of the art by preparing high chloride emulsions containing tabular grains with parallel twin planes and {111} major crystal faces using an aminoazaindene grain growth modifier and a gelatino-peptizer containing up to 30 micromoles per gram of methionine. Since the methionine content of gelatino-peptizer, if objectionably high, can be readily reduced by treatment with a strong oxidizing agent U.S. Pat. No. 4,713,323 placed within reach of the art high chloride tabular grain emulsions with significant bromide and iodide inclusions.

Further investigations of grain growth modifiers capable of preparing high chloride emulsions of similar tabular grain content followed. As grain growth modifiers, Tufano et al U.S. Pat. No. 4,804,621 and Houle et al U.S. Pat. No. 5,035,992 employed 4,6-di(hydroamino)pyrimidines lacking a 5-position amino substituent (a 2-hydroaminoazine species); Japanese patent application 03/116,133, published May 17, 1991, employed adenine in the pH range from 4.5 to 8.5; Takada et al U.S. Pat. No. 4,783,398 employed heterocycles containing a divalent sulfur ring atom; Nishikawa et al U.S. Pat. No. 4,952,491 employed spectral sensitizing dyes an divalent sulfur atom containing heterocycles and acyclic compounds; and Ishiguro et al U.S. Pat. No. 4,983,508 employed organic bis-quaternary amine salts.

For a practical application silver halide emulsions must be chemically and spectrally sensitized. Sensitization of adenine-generated AgCl tabular grains is disclosed in Maskasky U.S. Pat. No. 4,400,463, where spectral sensitization is performed first in the presence of bromide ion followed by chemical, sulfur-plus-gold sensitization in the presence of thiocyanaye ion at 65° C. Spectral sensitization of AgCl tabular grains by displacement of other than adenine growth modifier is disclosed in Tufano and Chan U.S. Pat. No. 4,804,621 (also U.S. Pat. No. 4,783,398 and U.S. Pat. No. 4,938,508). Further enhacements in spectral and chemical sensitization, and also adsorption of other photographically useful addenda, can be provided by by lowering the pH to protonate, and ultimately remove growth modifier from the crystal surface, as described in Maskasky U.S. Pat. Nos. 5,217,858 and 5,221,602. Specifically Jones and Osborne-Perry U.S. Pat. No. 5,176,991 describe a process of preparing an emulsion for photographic use comprising (1) forming an emulsion comprised of silver halide grains and a gelation-peptizer dispersing medium in which morphologically unstable tabular grains having {111} major faces account for greater than 50% of total grain projected area and contain at least 50 mole percent chloride, based on silver, the emulsion additionally containing at least one morphological stabilizer adsorbed to surfaces of the tabular grains, and (2) chemically sensitizing the tabular grains.

The process is characterized by the steps of choosing the morphological stabilizer from among 2-hydroaminoazines and xanthinoids, initiating protonation of the morphological stabilizer adsorbed to the tabular grain surfaces, performing the step of chemical sensitization while protonation of the morphological stabilizer is occurring, and terminating protonation of the morphological stabilizer so that at least a portion of the morphological stabilizer is retained on the surfaces of the chemically sensitized tabular grains.

As claimed in U.S. Pat. No. 5,176,991, by partially removing the morphological stabilizer during chemical sensitization greatly increased levels of photographic sensitivity can be achieved.

PROBLEM TO BE SOLVED BY THE INVENTION

The high chloride content of the tabular grains renders their {111} major faces unstable, since silver chloride strongly favors {100} crystal faces. Unfortunately, the tabular shape of the grains is destroyed when {100} crystal face emerge.

To allow the high chloride tabular grains to be formed a morphological stabilizer is employed that adsorbs to the {111} faces of the tabular grains. Preferred morphological stabilizers for practicing this invention are 2-hydroaminoazines and xanthinoid compounds (described below).

These compounds can be temporarily removed from the tabular grain crystal faces to allow chemical sensitization to occur by pH cycling. However, pH cycling is often a troublesome additional step in the sensitization process. Even temporary removal of stabilizing compound may allow for some degree of morphology change. Moreover, adjusting pH from higher values to lower can introduce undesirable fogging of the emulsion. All this may add to more variability during process development and implementation. It is, therefore, desired to find an alternative way to enhance the chemical and spectral sensitization of such emulsions without the need to introduce the pH cycling.

SUMMARY OF THE INVENTION

An object of the invention is to overcome disadvantages of prior sensitizing methods for high-chloride tabular silver halide grains with major {111} faces.

Another object is to provide a more reliable method of sensitization with less variability.

These and other objects of the invention are generally accomplished by providing a method of sensitizing high-chloride tabular grains having {111} major faces comprising providing such tabular grains and sensitizing the grains at temperatures greater than 70° C.

ADVANTAGEOUS EFFECT OF THE INVENTION

The invention provides numerous: advantages over prior sensitization methods. It is common practice in the art to carry out a heat ramp during a certain stage of emulsion sensitization. The most common temperature at which this operation is performed is 60°–70° C. because higher temperatures often lead to oversensitization and fog increases ("The Theory of the Photographic Processes" by T. H. James, 4th Edition, Macmillan Co. Ltd., New York, 1977). It is unexpected that in the case of high chloride tabular grain emulsions made with 2-hydroaminoazine or xanthinoids as growth modifier, higher than commonly used sensitization temperature, most preferred being that of 80° C. and higher, yields improved spectral and chemical sensitization over emulsions sensitized within the standard temperature range. The use of epitaxially deposited bromide and soluble bromide during spectral/chemical sensitization yielded clear advantages in combination with high temperature finish.

This invention is significant in that it offers a simple way of achieving good photographic results with high speed and low fog for silver chloride tabular grain emulsions. The invention is valid over wide range of imparted spectral sensitivities (red, greeen and blue) as demonstrated in the examples. Because of the simplicity of this sensitization scheme, which reduces operational errors, and provides good photographic performance, the invention may be highly economical and useful commercially.

DETAILED DESCRIPTION OF THE INVENTION

The present invention is directed to a process of preparing for photographic use high chloride tabular grain emulsions having {111} major faces.

Preferred high chloride tabular grain emulsions prepared in the practice of the invention contain tabular grains accounting for at least 50 percent of total grain projected area that contain at least 50 mole percent chloride, based on total silver. The tabular grains preferably contain less than 5 mole percent iodide. Bromide can account for the balance of the halide. In other words, the invention is applicable to emulsions in which the high chloride tabular grains are silver chloride, silver iodochloride, silver bromochloride, silver bromoiodochloride and/or silver iodobromochloride tabular grains. The chloride content of the tabular grains is preferably at least 80 mole percent and optimally at least 90 mole percent, based on the total silver, while the iodide content is preferably less than 2 mole percent and optimally less than 1 mole percent. When more than one halide ion is present in the tabular grains, the halides can be uniformly or nonuniformly distributed.

The photographic advantages of tabular grains are a function of their tabularity. Preferred emulsions in which the tabular grains exhibit a high mean tabularity—that is, they satisfy the mean tabularity relationship:

$$\frac{ECD}{t^2} > 25$$

where

ECD is the mean effective circular diameter of the high chloride tabular grains in μm and t is the mean thickness of the high chloride tabular grains in μm.

In terms of mean aspect ratios the high chloride tabular grains preferably exhibit high aspect ratios—that is, ECD/t >8. When high aspect ratio tabular grains exhibit a thickness of 0.3 μm or less, high tabularities can be realized at intermediate aspect ratios of 5 or more.

Maximum mean tabularities and mean aspect ratios are a function of the mean ECD of the high chloride tabular grains and their mean thickness. The mean ECD of the high chloride tabular grains can range up to the limits of photographic utility (that is, up to about 10 μm), but are typically 4 μm or less.

To maximize the advantages of having high chloride tabular grains present in the emulsions it is preferred that the high chloride tabular grains account for greater than 70 percent and, optimally, greater than 90 percent of total grain projected area. With care in preparation or when accompanied by conventional grain separation techniques the projected area accounted for by high chloride tabular grains can approximate 100 percent of total grain projected area for all practical purposes.

Grains other than the high chloride tabular grains when present in the emulsion are generally coprecipitated grains of the same halide composition. It is recognized that for a variety of applications the blending of emulsions is undertaken to achieve specific photographic objectives. Other emulsions can be blended before or after chemical sensitization in accordance with this invention, but are preferably blended after chemical sensitization to allow each emulsion component being blended to be separately optimally sensitized.

The growth modifiers utilized in the invention generally are 2-hydroaminoazine or xanthinoids. The essential structural components of the 2-hydroaminoazine can be visualized from the following formula:

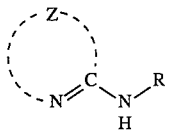

(I)

where

Z represents the atoms completing a 6 member aromatic heterocyclic ring, the ring atoms of which are either carbon or nitrogen and R represents hydrogen, any convenient conventional monovalent amino substituent group (e.g., a hydrocarbon or halohydrocarbon group), or a group that forms a 5- or 6-member heterocyclic ring fused with the azine ring completed by Z.

In one illustrative form the 2-hydroaminoazine can satisfy the formula:

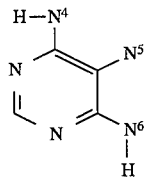

(II)

where $N^4$, $N^5$ and $N^6$ are independent amino moieties.

In a specifically preferred form the 2-hydroaminoazines satisfying formula II satisfy the following formula:

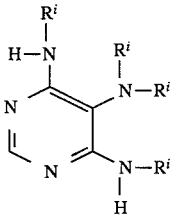

(III)

where $R^i$ is independently in each occurence hydrogen or alkyl of from 1 to 7 carbon atoms.

In still another illustrative form the 2-hydroaminoazine can satisfy the formula:

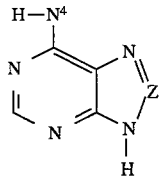

(IV)

where $N^4$ is an amino moiety and

Z represents the atoms completing a 5- or 6-member ring.

In the most preferred embodiment the 2-hydroaminoazine is adenine for improved sensitization.

Preferred xanthinoid morphological stabilizers are those satisfying the formula:

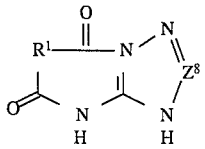

(V)

where $Z^8$ is —C($R^8$)= or —N=;

$R^8$ is H, $NH_2$ or $CH_3$; and $R^1$ is hydrogen or a hydrocarbon of from 1 to 7 carbon atoms.

When the xanthinoid is chosen to have a xanthine nucleus, the structure of the grain growth modifier is preferably as shown in the following formula:

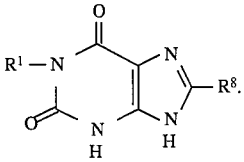

(VI)

When the xanthinoid is chosen to have an 8-azaxanthine nucleus, the structure of the grain growth modifier is preferably as shown in the following formula:

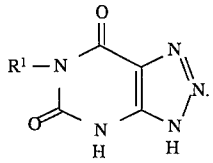

(VII)

No substituents of any type are required on the ring structures of formulae V to VII. Thus, each of $R^1$ and $R^8$ can in each occurrence be hydrogen. $R^8$ can in addition include a sterically compact hydrocarbon substituent, such as $CH_3$ or $NH_2$. $R^1$ can additionally include a hydrocarbon substituent of from 1 to 7 carbon atoms. Each hydrocarbon moiety is preferably an alkyl group, e.g., methyl, ethyl, n-propyl, i-propyl, n-butyl, i-butyl, t-butyl, etc., although other hydrocarbons, such as cyclohexyl or benzyl, are contemplated. To increase grain growth modifier solubility the hydrocarbon groups can, in turn, be substituted with polar groups, such as hydroxy, sulfonyl or amino groups, or the hydrocarbon groups can be substituted with other groups that do not materially modify their properties (e.g., a halo substituent), if desired.

An aqueous gelatino-peptizer dispersing medium is present during precipitation. Gelatino-peptizers include gelatin, e.g., alkali-treated gelatin (cattle bone and hide gelatin) or acid-treated gelatin (pigskin gelatin) and gelatin derivatives, e.g., acetylated gelatin, phthalated gelatin, and the like.

The process of the invention is not restricted to use with gelatino-peptizers of any particular methionine content; that is, gelatino-peptizers with all naturally occurring methionone levels are useful. It is, of course, possible, though not required, to reduce or eliminate methionine by oxidation treatment.

Chemical sensitization of the materials in this process is accomplished by any of a variety of known chemical sensitizers. The use of sulfur, sulfur plus gold or gold only sensitizations are effective. Typical gold sensitizers are chloroaurates, aurous dithiosulfate, aqueous colloidal gold sulfide or gold(aurous bis(1,4,5-trimethyl- 1,2,4-triazolium-3-thiolate) tetrafluoroborate. Sulfur sensitizers may include thiosulfate, thiocyanate or N,N'-carbobothioyl-bis(N-methylglycine).

Although the sensitizers sometimes affect photographic speed without the need of heating between the times of addition of sensitizer and coating of the liquid emulsion, usually a heat treatment, variously called chemical ripening, digestion, second ripening, or after ripening, is both desired and required. It is rarely desirable that the sensitizing reaction proceed at the temperature at which the sensitizer is added (for example, 40° C.); instead it should take place at a somewhat higher temperature (commonly 55°–75° C.). Control of the extent of the reaction during digestion is important; too little or too much usually results in photographic speeds lower than those attained with an intermediate, optimum amount of digestion. For instance, oversensitization by too high concentrations of sensitizers, too high temperature, or too long digestion time often leads to fog and relatively low speed.

The silver halide emulsions of this invention can be spectrally sensitized with dyes from a variety of classes, including the polymethine dye class, which includes the cyanines, merocyanines, complex cyanines and merocyanines (i.e., tri-, tetra-, and poly-nulcear cyanines and merocyanines), oxonols, hemioxonols, styryls, merostyryls, and streptocyanines.

The cyanine spectral sensitizing dyes include, joined by a methine linkage, two basic heterocyclic nuclei, such as those derived from quinolinium, pyridinium, isoquinolinium, 3H-indolium, benz(e)indolium, oxazolium, thiazolium, selenazolium, imidazolium, benzoxazolium, benzothiazolium, benzoselenazolium, benzimidazolium, naphtooxazolium, naphtothiazolium, naphtoselenazolium, thiazolinium dihydronaphtothiazolium, pyrylium, and imidazopyrazinium quaternary salts.

The merocyanine spectral sensitizing dyes include, joined by a methine linkage, a basic herterocyclic nucleus of the cyanine dye type and an acidic nucleus, such as can be derived from barbituric acid, 2-thiobarbituric acid, rhodanine, hydantoin, 2-thiohydantoin, 4-thiohydantoin, 2-pyrazolin-5-one, 2-isoxazoli- 5-oneindan-1,3-dione, cyclohexan-1,3-dione, 1,3-dioxan-4.6-dione, pyrazolin-3,5-dione, pentan-2,4-dione, alkylsulfonyl acetonitrile, melononintrile, isoquinolin-4-one, and chroman-2,4-dione.

One or more spectral sensitizing dyes may be used. Dyes with sensitizing maxima at wavelengths throughout the visible spectrum and with a great variety of spectral sensitivity curve shapes are known.

Combinations of spectral sensitizing dyes can be used which result is supersensitization; that is, spectral sensitization that is greater in some spectral region than that from any concentration of one of these dyes alone or that which would result from the additive effect of the dyes.

The addition of one or more antifoggants as stain reducing agents is also common in silver halide systems. Tetrazaindenes, such as 4-hydroxy-6-methyl-( 1,3,3a,7)-tetrazaindene, are commonly used as stabilizers. Also useful are mercaptotetrazoles such as 1-phenyl-5-mercaptotetrazole or acetamido-1-phenyl-5-mercaptotetrazole. Arylthiosulfinates, such as tolylthiosulfonate or arylsulfinates such as tolylthiosulfinate or esters thereof are also especially useful.

The final effectiveness of the chemical and spectral sensitization of silver chloride tabular grain emulsions having {111} major faces appears to be a result of complex adsorption and surface reactions phenomena with different activation energies and kinetics. Temperature of digestion affect these reactions to a large extent. The net result within commonly used in the art temperature ranges (55°–70° C.) was rather poor sensitizations resulting in low photographic speeds. pH cycling was proposed to overcome these difficulties. As an unexpected alternative we have found that raising the digestion temperature above 70° C. offers some unique advantages. Temperature of 80° C. is the most preferred. In the presence of spectral sensitizing dyes at least two processes influence greatly the final photographic parameters of the emulsion: dye desensitization and displacement of growth modifier from the surface of the grain; the latter rendering emulsion more active for sensitization reactions. Comparative examples run at finish temperature of 60° C. do show a strong desensitization effect for the dyes used (as measured by the response to the 365 nm Hg line exposure). Quite unexpectedly, however, when the temperature was raised to 80° C., good chemical and spectral sensitization was achieved, as well as dye adsorption on the grain was enhanced (as measured by spectrophotometer).

The emulsion obtained by the invented process can be utilized in both black and white and color photographic systems with advantages derived from the grain morphology. In particular, high chloride tabular grain emulsions offer a potential to improve the rate and ecology of development and fixing of radiographic films. X-ray films use silver bromoiodide or bromide emulsions and are processed in conventional roller transport processors using conventional RP XOMAT developer and fixer formulations. Because of desires to improve both processing rates and ecological impact, attention has been focused on ways to improve kinetics of processing. Highly developable high-chloride emulsions of this invention sensitized to high photographic speed might offer unique opportunities in this system. High developability of high chloride tabular grains can be also utilized in systems using rapid access process chemistry, such as color paper.

The following examples illustrate the practice of this invention. They are not intended to be exhaustive of all possible variations of the invention. Parts and percentages are by weight, unless stated otherwise.

EXAMPLE 1

The silver chloride tabular grain emulsion was precipitated according to the formula described in U.S. Pat. No. 5,176,991 using adenine as a growth modifier. A small amount of phenylomercaptotetrazole was added to the chloride feed solution. At the end of precipitation, 1% of silver bromide (in terms of silver) was introduced by simultaneous addition of 0.01 molar solution of silver nitrate and 0.025 molar solution of sodium bromide. The resultant emulsion was predominantly tabular grain emulsion (more than 80% by number) with ECD=1 μm and thickness about 0.1 μm. The emulsion was washed using ultrafiltration unit, and its pH and pCl were adjusted to 5.8 and 1.8, respectively. A total of 50 moles of AgCl was precipitated. Eight equimolar parts of this emulsion were sensitized as follows:

Part 1: 137 mg of Compound A per mole of silver was added to the emulsion and then it was held for 20 minutes at 60° C. This emulsion will be referred to as "primitive at 60° C.".

Part 2: 137 mg of Compound A per mole of silver was added to the emulsion and then it was held for 20 minutes at 80° C. This emulsion will be referred to as "primitive at 80° C.".

Part 3: Dye A (blue sensitizing) was added to the emulsion, followed by the addition of sodium thiosulfate, potassium chloroaurate, potassium thiocyanate, Compound A, and then the emulsion was stirred at 40° C. for 5 minutes. Subsequent heat treatment included heating it up to 60° C. and holding for 20 minutes.

Part 4: Dye A (blue sensitizing) was added to the emulsion, followed by the addition of sodium thiosulfate, potassium chloroaurate, potassium thiocyanate, Compound A, and then the emulsion was stirred at 40° C. for 5 minutes. Subsequent heat treatment included heating it up to 80° C. and holding for 20 minutes.

Part 5: Dye B (green sensitizing) was added to the emulsion, followed by the addition of sodium thiosulfate, potassium chloroaurate, potassium thiocyanate, Compound A, and then emulsion was stirred at 40° C. for 5 minutes. Subsequent heat treatment included heating it up to 60° C. and holding for 20 minutes.

Part 6: Dye B (green sensitizing) was added to the emulsion, followed by the addition of sodium thiosulfate, potassium chloroaurate, potassium thiocyanate, Compound A, and then the emulsion was stirred at 40° C. for 5 minutes. Subsequent heat treatment included heating it up to 80° C. and holding for 20 minutes.

Part 7: Dye C (red sensitizing) was added to the emulsion, followed by the addition of sodium thiosulfate, potassium chloroaurate, potassium thiocyanate, Compound A, and then the emulsion was stirred at 40° C. for 5 minutes. Subsequent heat treatment included heating it up to 60° C. and holding for 20 minutes.

Part 8: Dye C (red sensitizing) was added to the emulsion, followed by the addition of sodium thiosulfate, potassium chloroaurate, potassium thiocyanate, Compound A, and then the emulsion was stirred at 40° C. for 5 minutes. Subsequent heat treatment included heating it up to 80° C. and holding for 20 minutes.

All emulsions were adjusted for an appropriate gelatin and coating addenda content and coated on clear support at 300 mg silver/sq.ft. The coating addenda are saponin and glycerine. Film strips were subjected to sensitometric gradation exposure using 365 nm mercury line and daylight white light. Exposure time was 1/10 sec. All the coatings were developed for 6 minutes in Kodak black-and-white DK-50 process.

Results

All the results are summarized in the table below. Relative speed was measured at Dmin +0.8 density level. Percent absorptance of the dye was taken at the maximum absorptance for each dye.

TABLE 1

Fresh sensitometry and dye absorption - Example 1

| | | | Relative Speed | | | Spectrophometer Data | |
|---|---|---|---|---|---|---|---|
| Part | Dye | Temp. (°C.) | 365 nm | white light | Dmin | Percent Absorptance | Wavelength (nm) |
| 1 | — | 60 | 151 | 4 | 0.054 | — | — |
| 2 | — | 80 | 106 | 19 | 0.107 | — | — |
| 3 | Dye A | 60 | 70 | 30 | 0.156 | 39.7 | (465) |
| 4 | Dye A | 80 | 165 | 173 | 0.100 | 44.8 | (465) |
| 5 | Dye B | 60 | 108 | 100 | 0.146 | 51.1 | (545) |
| 6 | Dye B | 80 | 172 | 230 | 0.180 | 60.3 | (546) |
| 7 | Dye C | 60 | 73 | 10 | 0.184 | 73.6 | (654) |
| 8 | Dye C | 80 | 153 | 198 | 0.320 | 80.0 | (655) |

As it is clearly seen, the higher temperature "primitive" emulsion (part 2) did not gain any speed over that finished at 60° C. Spectral and chemical sensitization at 60° C. (parts 3, 5, and 7) did not bring any advantage over that of "primitive" (part 1) and, in fact, significant desensitization effect was observed. Spectral and chemical sensitization at 80° C. (parts 4, 6, and 8), clearly worked very well with large speed gains at low Dmin levels. Noticeably better absorptance for J-aggregates is also evident at higher temperature.

EXAMPLE 2

The silver chloride tabular grain emulsion was precipitated according to the formula described in U.S. Pat. No. 5,176,991 using adenine as a growth modifier. A small amount of mercuric chloride was added to the silver feed solution. At the end of precipitation 1% of silver bromide was introduced (in terms of silver) by simultaneous addition of 0.01 molar solution of silver nitrate and 0.025 molar solution of sodium bromide. The resultant emulsion was predominantly tabular grain emulsion (more than 80% by number) with ECD=0.88 μm and thickness about 0.095 μm. The emulsion was washed, using an ultrafiltration unit and its pH and pCl were adjusted to 5.8 and 1.8, respectively. A total of 5 moles of AgCl was precipitated. Fourteen equimolar parts of this emulsion were sensitized as follows:

Part 1: 137 mg of Compound A per mole of silver was added to the emulsion and then it was held for 20 minutes at 80° C. This emulsion will be reffered to as "primitive".

Part 2: Sodium thiosulfate, potassium chloroaurate, potassium thiocyanate, and Compound A were added to the emulsion and then it was stirred at 40° C. for 5 minutes. Subsequent heat treatment included heating it up to 80° C. and holding for 20 minutes. This emulsion will be referred to as "no dye".

Part 3: Dye A (blue sensitizing) was added to the emulsion, followed by the addition of sodium thiosulfate, potassium chloroaurate, potassium thiocyanate, Compound A, and then the emulsion was stirred at 40° C. for 5 minutes. Subsequent heat treatment included heating it up to 80° C. and holding for 10 minutes.

Part 4: Dye A (blue sensitizing) was added to the emulsion, followed by the addition of sodium thiosulfate, potassium chloroaurate, potassium thiocyanate, Compound A, and then the emulsion was stirred at 40° C. for 5 minutes. Subsequent heat treatment included heating it up to 80° C. and holding for 15 minutes.

Part 5: Dye A (blue sensitizing) was added to the emulsion, followed by the addition of sodium thiosulfate, potassium chloroaurate, potassium thiocyanate, Compound A, and then the emulsion was stirred at 40° C. for 5 minutes. Subsequent heat treatment included heating it up to 80° C. and holding for 20 minutes.

Part 6: Dye A (blue sensitizing) was added to the emulsion, followed by the addition of sodium thiosulfate, potassium chloroaurate, potassium thiocyanate, Compound A, and then the emulsion was stirred at 40° C. for 5 minutes. Subsequent heat treatment included heating it up to 80° C. and holding for 25 minutes.

Part 7: Dye B (green sensitizing) was added to the emulsion, followed by the addition of sodium thiosulfate, potassium chloroaurate, potassium thiocyanate, Compound A, and then the emulsion was stirred at 40° C. for 5 minutes. Subsequent heat treatment included heating it up to 80° C. and holding for 10 minutes.

Part 8: Dye B (green sensitizing) was added to the emulsion, followed by the addition of sodium thiosulfate, potassium chloroaurate, potassium thiocyanate, Compound A, and then the emulsion was stirred at 40° C. for 5 minutes. Subsequent heat treatment included heating it up to 80° C. and holding for 15 minutes.

Part 9: Dye B (green sensitizing) was added to the emulsion, followed by the addition of sodium thiosulfate, potassium chloroaurate, potassium thiocyanate, Compound A, and then the emulsion was stirred at 40° C. for 5 minutes. Subsequent heat treatment included heating it up to 80° C. and holding for 20 minutes.

Part 10: Dye B (green sensitizing) was added to the emulsion, followed by the addition of sodium thiosulfate, potassium chloroaurate, potassium thiocyanate, Compound A, and then the emulsion was stirred at 40° C. for 5 minutes. Subsequent heat treatment included heating it up to 80° C. and holding for 25 minutes.

Part 11: Dye C (red sensitizing) was added to the emulsion, followed by the addition of sodium thiosulfate, potassium chloroaurate, potassium thiocyanate, FOG-0901, and then the emulsion was stirred at 40° C. for 5 minutes. Subsequent heat treatment included heating it up to 80° C. and holding for 10 minutes.

Part 12: Dye C (red sensitizing) was added to the emulsion, followed by the addition of sodium thiosulfate, potassium chloroaurate, potassium thiocyanate, Compound A, and then the emulsion was stirred at 40° C. for 5 minutes. Subsequent heat treatment included heating it up to 80° C. and holding for 15 minutes.

Part 13: Dye C (red sensitizing) was added to the emulsion, followed by the addition of sodium thiosulfate, potassium chloroaurate, potassium thiocyanate, Compound A, and then the emulsion was stirred at 40° C. for 5 minutes. Subsequent heat treatment included heating it up to 80° C. and holding for 20 minutes.

Part 14: Dye C (red sensitizing) was added to the emulsion, followed by the addition of sodium thiosulfate, potassium chloroaurate, potassium thiocyanate, Compound A, and then the emulsion was stirred at 40° C. for 5 minutes. Subsequent heat treatment included heating it up to 80° C. and holding for 25 minutes.

All emulsions were adjusted for an appropriate gelatin and coating addenda content and coated on clear support at 300 mg silver/sq.ft. Film strips were subjected to sensitometric gradation exposure using 365 nm mercury line and daylight white light. Exposure time was 1/10 sec. All the coatings were developed for 6 minutes in Kodak black-and-white DK-50.

TABLE 2

| Fresh sensitometry - Example 2 | | | | | |
|---|---|---|---|---|---|
| | | Heating Time | | Relative Speed | |
| Part | Dye | (minutes) | Dmin | 365 nm | white light |
| 1 | primitive | 20 | 0.096 | 90 | 28 |
| 2 | no dye | 20 | 0.480 | 112 | 50 |
| 3 | Dye A | 10 | 0.064 | 160 | 163 |
| 4 | Dye A | 15 | 0.180 | 160 | 160 |
| 5 | Dye A | 20 | 0.106 | 162 | 163 |
| 6 | Dye A | 25 | 0.136 | 164 | 162 |
| 7 | Dye B | 10 | 0.113 | 162 | 209 |
| 8 | Dye B | 15 | 0.095 | 162 | 200 |
| 9 | Dye B | 20 | 0.095 | 160 | 200 |
| 10 | Dye B | 25 | 0.151 | 158 | 197 |
| 11 | Dye C | 10 | 0.149 | 170 | 172 |
| 12 | Dye C | 15 | 0.123 | 172 | 170 |
| 13 | Dye C | 20 | 0.142 | 170 | 174 |

TABLE 2-continued

| Fresh sensitometry - Example 2 | | | | | |
|---|---|---|---|---|---|
| | | Heating Time | | Relative Speed | |
| Part | Dye | (minutes) | Dmin | 365 nm | white light |
| 14 | Dye C | 25 | 0.129 | 172 | 168 |

Chemical sensitization of a given tabular grain emulsion in the absence of spectral sensitizing dye produces large Dmin increase at little speed advantage. Unexpectedly, the presence of spectral sensitizing dyes result in large speed gains at low Dmin levels for high temperature sensitization. Moreover, the time of heat treatment is not important, with the shorter times (here 10 min.) being preferred. This is another proof of the unique effect of the elevated temperature in the claimed system. Moreover, shorter digestion times are preferred in manufacturing of silver halide emulsions.

EXAMPLE 3

It is desirable to be able to utilize the rapid access processes for silver chloride light sensitive material as used, for example, in color paper.

The silver chloride tabular grain emulsion described in Example 2 was used. 8 equimolar parts were sensitized as follows:

Part 1: 67.9 mg of Compound A per silver mole was added to the emulsion after it was held for 10 minutes at 80° C. This emulsion will be referred to as "primitive".

Part 2: Sodium thiosulfate, potassium thiocyanate, potassium chloroaurate were added to the emulsion and then it was stirred at 40° C. for 5 minutes. Subsequent heat treatment included heating-it up to 80° C. and holding for 10 minutes. After the emulsion has been cooled down to 40° C., Compound A was added. This emulsion will be referred to as "no dye".

Part 3: Dye D (blue sensitizing) was added to the emulsion, followed by the addition of 1% soluble bromide, sodium thiosulfate, potassium thiocyanate, potassium chloroaurate and then emulsion was stirred at 40° C. for 5 minutes. Subsequent heat treatment included heating it up to 60° C. and holding for 10 minutes. After the emulsion has been cooled down to 40° C., Compound A was added.

Part 4: Dye D (blue sensitizing) was added to the emulsion, followed by the addition of sodium thiosulfate, potassium thiocyanate, potassium chloroaurate and then the emulsion was stirred at 40° C. for 5 minutes. Subsequent heat treatment included heating it up to 80° C. and holding for 10 minutes. After the emulsion has been cooled down to 40° C., Compound A was added.

Part 5: Dye D (blue sensitizing) was added to the emulsion, followed by the addition of 1% soluble bromide, sodium thiosulfate, potassium thiocyanate, potassium chloroaurate and then the emulsion was stirred at 40° C. for 5 minutes. Subsequent heat treatment included heating it up to 80° C. and holding for 10 minutes. After the emulsion has been cooled down to 40° C. Compound A was added.

Part 6: Dye A (blue sensitizing) was added to the emulsion, followed by the addition of 1% soluble bromide, sodium thiosulfate, potassium thiocyanate, potassium chloroaurate and then the emulsion was stirred at 40° C. for 5 minutes. Subsequent heat treatment included heating it up to 60° C. and holding for 10 minutes. After the emulsion has been cooled down to 40° C., Compound A was added.

Part 7: Dye A (blue sensitizing) was added to the emulsion, followed by the addition of sodium thiosulfate, potassium thiocyanate, potassium chloroaurate and then emulsion was stirred at 40° C. for 5 minutes. Subsequent heat treatment included heating it up to 80° C. and holding for 10 minutes. After the emulsion has been cooled down to 40° C., Compound A was added.

Part 8: Dye A (blue sensitizing) was added to the emulsion, followed by the addition of 1% soluble bromide, sodium thiosulfate, potassium thiocyanate, potassium chloroaurate and then the emulsion was stirred at 40° C. for 5 minutes. Subsequent heat treatment included heating it up to 80° C. and holding for 10 minutes. After the emulsion has been cooled down to 40° C., Compound A was added.

All emulsions were dual mixed with yellow coupler dispersion (Coupler A) which was stabilized by benzenosulfonic acid prior to coating at 26 mg of silver, 100 mg of coupler and 77 mg of gelatin per square foot on resin coated paper support. Subsequently, the coated emulsions were subjected to sensitometric gradation exposure at exposure time of 1.25 sec. All the coatings were developed in Kodak RA-4 chemistry as described in Research Disclosure, Vol. 308, p. 933, 1989. Development time was 45 and 90 seconds. Relative speed was measured at Dmin+0.8.

The results are summarized in the table below:

TABLE 3

Fresh sensitometry - Example 3

| | | 365 nm exposure | | | |
|---|---|---|---|---|---|
| | | Dev. time = 45° | | Dev. time = 90° | |
| Part | Dye/Br/Temp | Dmin | Speed | Dmin | Speed |
| 1 | primitive | 0.11 | — | 0.16 | — |
| 2 | no dye | 0.46 | 145 | 1.00 | 52 |
| 3 | Dye D/Br/60° C. | 0.10 | 126 | 0.16 | 48 |
| 4 | Dye D/80° C. | 0.17 | — | 0.22 | 60 |
| 5 | Dye D/Br/80° C. | 0.36 | 120 | 0.67 | 212 |
| 6 | Dye A/Br/60° C. | 0.07 | — | 0.09 | 108 |
| 7 | Dye A/80° C. | 0.12 | 30 | 0.20 | 155 |
| 8 | Dye A/Br/80° C. | 0.10 | 50 | 0.15 | 190 |

The present invention is illustrated by comparison of Parts 3 and 5 at 90 seconds development time and by Parts 6 and 8 at 45 and 90 seconds development time. In both cases, huge speed gains are seen by rising temperature to 80° C., albeit somewhat elevated fog appears for Dye D. Standard 45-sec. development time was too short for Dye D, but still relatively rapid development took place at 90 seconds. It must be noted that soluble bromide during finish improves its efficiency dramatically. The role of the presence of bromide in the finish is illustrated in series of spectral sensitometer exposures in Table 4. In the spectrophotometer the exposures are made every 10 ns and the emulsion characteristic curve is determined at the peak spectral sensitivity ($\lambda_{max}$). Relative speeds at $\lambda_{max}$ are determined at the absolute density of 1.0.

TABLE 4

Spectral sensitivity - Example 3

| Part | Dye/Br/Temp | $\lambda$max | Speed at $\lambda$max |
|---|---|---|---|
| 2 | no dye | 400 | 100 |

TABLE 4-continued

Spectral sensitivity - Example 3

| Part | Dye/Br/Temp | $\lambda$max | Speed at $\lambda$max |
|---|---|---|---|
| 3 | Dye D/Br/60° C. | 400 | 45 |
| 4 | Dye D/80° C. | 470 | 58 |
| 5 | Dye D/Br/80° C. | 470 | 150 |
| 6 | Dye A/Br/60° C. | 470 | 100 |
| 7 | Dye A/80° C. | 470 | 165 |
| 8 | Dye A/Br/80° C. | 470 | 188 |

High temperature finish moves peak spectral sensitivity of dye D toward longer wavelengths which is indicative of dye aggregation on the crystal surface. The effect of the presence of bromide in the finish as well as high finish temperature is evident in the higher speed sensitization and higher wavelength sensitivity in this rapid access developer.

Compound A: 1-(3-acetoamidophenyl)-5-mercaptotetrazole

Dye A:

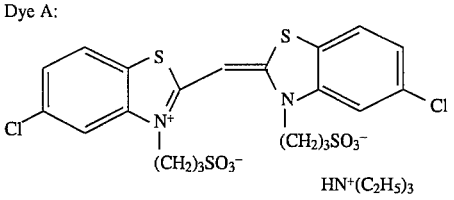

Dye B:

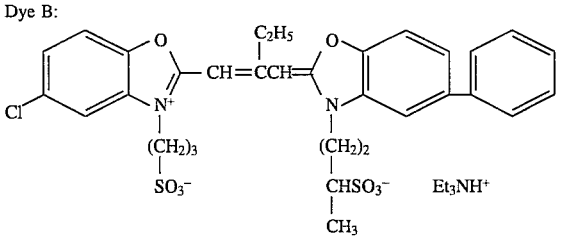

Dye C:

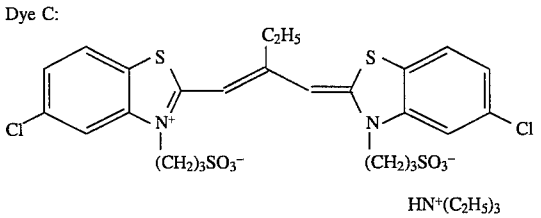

Dye D:

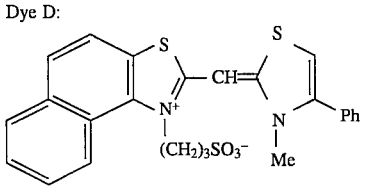

Coupler A:

The invention has been described in detail with particular reference to preferred embodiments thereof, but it will be understood that variations and modifications can be effected within the spirit and scope of the invention.

We claim:

1. A method of sensitizing high chloride tabular grains having {111} major faces comprising providing high chloride tabular grains having {111} major faces, and sensitizing at temperatures greater than 80° C. with the proviso that said grains contain at least 50 mole percent chloride based on total silver, a 2-hydroaminoazine or xanthinoid compound is present during sensitization, and bromide is added during sensitization.

2. The method of claim 1 wherein a spectral sensitizing dye is present in the emulsion during chemical sensitization.

3. The method of claim 2 wherein said dye comprises a J-aggregating dye.

4. The method of claim 1 wherein chemical sensitizers are added prior to heating for sensitization.

5. The method of claim 4 wherein said chemical sensitizers comprise gold compounds and sulfur compounds.

6. The method of claim 1 wherein said high chloride grains further comprise bromide.

7. The method of claim 1 wherein at least one of potassium chloroaurate, colloidal gold sulfide or sodium thiosulfate is present during heating.

8. The method of claim 1 wherein said grain contain at least 80 mole percent chloride.

9. The method of claim 8 wherein said grains contain less than 2 mole percent iodide.

10. The method of claim 1 wherein said grains contain at least 90 mole percent chloride.

11. The method of claim 1 wherein a xanthinoid compound is present during sensitization.

12. The method of claim 1 wherein present during sensitization is at least one of the dyes selected from the group consisting of

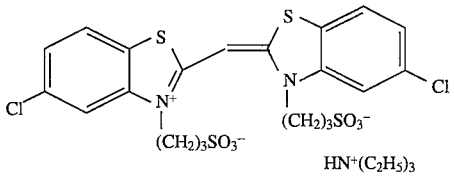

-continued

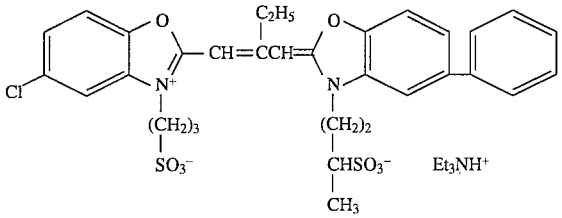

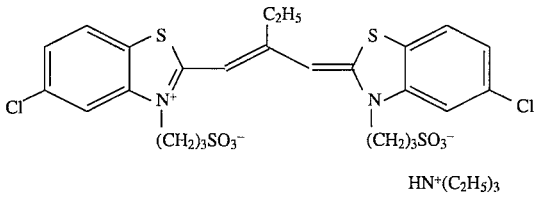

and

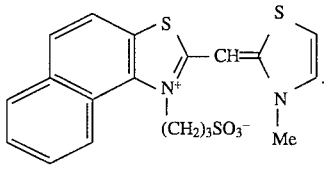

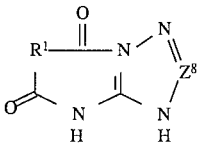

(V)

* * * * *